US007369149B2

(12) United States Patent
Uemura et al.

(10) Patent No.: US 7,369,149 B2
(45) Date of Patent: May 6, 2008

(54) IMAGE RECORDING METHOD AND IMAGE RECORDING DEVICE FOR CORRECTING OPTICAL MAGNIFICATION ERRORS

(75) Inventors: Takayuki Uemura, Kanagawa (JP); Daisuke Nakaya, Kanagawa (JP); Takeshi Fujii, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 314 days.

(21) Appl. No.: 10/880,445

(22) Filed: Jul. 1, 2004

(65) Prior Publication Data

US 2005/0001895 A1 Jan. 6, 2005

(30) Foreign Application Priority Data

Jul. 2, 2003 (JP) ..... 2003-190432

(51) Int. Cl.
*B41J 2/47* (2006.01)
*B41J 2/455* (2006.01)

(52) U.S. Cl. ..... 347/235; 347/233

(58) Field of Classification Search ..... 347/254, 347/235, 242; 359/237; 378/162; 358/466
See application file for complete search history.

(56) References Cited

U.S. PATENT DOCUMENTS 4,841,375 A * 6/1989 Nakajima et al. ..... 358/466
5,132,723 A 7/1992 Gelbart
5,668,588 A * 9/1997 Morizumi et al. ..... 347/242
6,624,877 B2 * 9/2003 Uemura et al. ..... 355/47
2002/0044265 A1 * 4/2002 Sumi ..... 355/47
2002/0057328 A1 * 5/2002 Fujii ..... 347/234
2002/0092993 A1 7/2002 Kanatake et al.
2002/0140801 A1 * 10/2002 Kubota ..... 347/239
2003/0021493 A1 * 1/2003 Nakaya et al. ..... 382/305
2003/0053598 A1 * 3/2003 Sumi et al. ..... 378/162
2004/0109216 A1 * 6/2004 Nakaya et al. ..... 359/237

FOREIGN PATENT DOCUMENTS

JP 57191785 * 11/1982
JP 06198953 A * 7/1994

* cited by examiner

*Primary Examiner*—Stephen Meier
*Assistant Examiner*—Carlos A. Martinez, Jr.
(74) *Attorney, Agent, or Firm*—Sughrue Mion PLLC

(57) ABSTRACT

An image recording method of recording an image onto an image recording surface by dot patterns by scanning a recording head having recording element units arranged in a direction intersecting a scanning direction, the recording element units having a light source and an optical system which receives light from the light source, forms light beams which are arranged two-dimensionally, and focuses the light beams on the image recording surface. The method includes: measuring displacement amounts of positions of light beam spots on the image recording surface generated due to a change in optical magnification of the optical system; changing a light-emitting timing at a time of start of scanning in the scanning direction, on the basis of a displacement amount in the scanning direction; and changing a resolution in the direction intersecting the scanning direction, on the basis of a displacement amount in the direction intersecting the scanning direction.

20 Claims, 6 Drawing Sheets

IMAGE RECORDING METHOD AND IMAGE RECORDING DEVICE FOR CORRECTING OPTICAL MAGNIFICATION ERRORS

CROSS-REFERENCE TO RELATED APPLICATION

This application claims priority under 35 USC 119 from Japanese Patent Application No. 2003-190432, the disclosure of which is incorporated by reference herein.

BACKGROUND OF THE INVENTION

1. Field of the Invention

The present invention relates to an image recording method and an image recording device which record an image on an image recording surface. More specifically, the present invention relates to an image recording method and an image recording device which record an image onto an image recording surface by dot patterns, by scanning, along the image recording surface, a recording head which is structured such that a plurality of recording element units are arranged in a direction intersecting a scanning direction.

2. Description of the Related Art

Conventionally, various image recording devices have been proposed which record an image onto a recording medium by using a recording head which irradiates a light beam which is modulated in accordance with image data by using a spatial light modulator (a recording element) such as a digital micromirror device (DMD) or the like (see, for example, U.S. Pat. No. 5,132,723).

For example, a DMD is a mirror device in which a large number of micromirrors, at which the angles of the reflecting surfaces thereof are varied in accordance with control signals, are arranged two-dimensionally in L lines×M columns on a semiconductor substrate formed of silicon or the like. By irradiating light onto the DMD from a single light source, a plurality of lights corresponding to the resolution of the DMD can be independently modulated and controlled.

Generally, recording elements such as DMDs or the like are arranged in a grid-like form (the form of a matrix) such that the direction in which the respective lines are arranged and the direction in which the respective columns are arranged are orthogonal to one another. By disposing the recording elements at an incline with respect to the scanning direction, the intervals between the scan lines at the time of scanning can be made to be closer, and the resolution can be increased.

However, in optical systems including such DMDs, there are cases in which errors in the optical magnifications arise. When errors in the optical magnifications arise, the recording positions of the dot patterns become offset, and positional offset arises in the recorded image.

In order to overcome this problem, a mechanism for adjusting the optical magnification must be provided (see, for example, U.S. Patent Application Publication No. 2002/0092993 A1). However, the optical magnification adjusting mechanism is extremely complex, and when the mechanism requires adjustment in order to accommodate changes over time, the work is extremely complex, which leads to poor operability.

It has been thought to planarly rotate the recording heads, which are arranged in two dimensions, so as to adjust the pitches between the respective dots. In this way, the pitches between the dots in the direction intersecting the scanning direction can be made to match. Note that, in the scanning direction, it suffices to absorb the error by changing the scanning speed.

However, when the recording head is structured such that a plurality of recording element units are arranged in a direction intersecting the scanning direction, a rotation adjusting mechanism must be provided for each of the recording element units in order to carry out the above-described adjustment. Further, cases in which the respective recording element units have different optical magnifications cannot be addressed.

SUMMARY OF THE INVENTION

In view of the aforementioned, an object of the present invention is to provide an image recording method and an image recording device in which, in a case in which an image is recorded by a recording head which is structured by lining-up a plurality of recording element units in a direction intersecting a scanning direction, even if errors in the optical magnifications of the respective recording element units arise, offset of the image recording positions can be corrected without using a mechanical adjusting mechanism.

A first aspect of the present invention provides an image recording method of recording an image onto an image recording surface by dot patterns by scanning, along the image recording surface, a recording head which is structured such that a plurality of recording element units are arranged in a direction intersecting a scanning direction, the recording element units having a light source and an optical system which receives light from the light source, forms light beams which are arranged two-dimensionally, and focuses the light beams on the image recording surface, the method comprising: measuring displacement amounts of positions of light beam spots on the image recording surface generated due to a change in optical magnification of the optical system; changing a light-emitting timing at a time of start of scanning in the scanning direction, on the basis of a displacement amount in the scanning direction; and changing a resolution in the direction intersecting the scanning direction, on the basis of a displacement amount in the direction intersecting the scanning direction.

Light beams illuminated from the light source onto the image recording surface are guided via optical systems. Therefore, there are cases in which the magnifications of the optical systems (the optical magnifications) vary due to physical differences (e.g. instrumental errors) among the optical systems or the assembled states thereof, or the environmental temperature or humidity or the like. In such cases, at the recording element units which are arranged two-dimensionally, the positions of the dot patterns vary due to the changes in the optical magnifications.

Thus, the displacement amounts of the positions of the light beam spots on the image recording surface generated by the changes in the optical magnifications of the optical systems are measured.

The light-emitting timing at the start of scan is changed on the basis of the displacement amount in the scanning direction, among the measured displacement amounts.

Further, the resolution in the direction intersecting the scanning direction is changed on the basis of the displacement amount in the direction intersecting the scanning direction, among the measured displacement amounts.

In this way, an adjusting mechanism which mechanically adjusts the positions of the recording element units or the like is not needed, and even if there are fluctuations in the optical magnifications, positional offset does not arise.

Further, the changing of the resolution in the direction intersecting the scanning direction is changing a number of dot patterns so that a line width in the direction intersecting the scanning direction becomes the same as a predetermined line width in the direction intersecting the scanning direction recorded at a standard optical magnification.

For example, in a case in which the change in the optical magnification is toward the enlargement side, the line width is enlarged when recording is carried out at a number of dot patterns which is equal to the number of dot patterns in the direction orthogonal to the scanning direction which is set in order to record lines of predetermined widths (line widths) at a standard optical magnification. Here, by decreasing the number of dot patterns (i.e., by lowering the resolution) on the basis of the enlarged displacement amount, the line width can be made equivalent to that at the time of the standard optical magnification. Note that, when the change in the optical magnification is toward the reduction side, it suffices to increase the resolution.

It is presumed that the resolution of the output image is increased in advance with respect to the original image, in order for the resolution change of the recorded image to not be lower than the resolution of the original image.

A second aspect of the present invention provides an image recording device for recording an image onto an image recording surface by dot patterns by scanning, along the image recording surface, a recording head which is structured such that a plurality of recording element units are arranged in a direction intersecting a scanning direction, the recording element units having a light source and an optical system which receives light from the light source, forms light beams which are arranged two-dimensionally, and focuses the light beams on the image recording surface, the device comprising: a displacement amount measuring mechanism measuring displacement amounts of positions of light beam spots on the image recording surface generated due to a change in optical magnification of the optical system; a light-emitting timing changing mechanism changing a light-emitting timing at a time of start of scanning in the scanning direction, on the basis of a displacement amount in the scanning direction; and a resolution changing mechanism changing a resolution in the direction intersecting the scanning direction, on the basis of a displacement amount in the direction intersecting the scanning direction.

The light beams illuminated from the light source onto the image recording surface are guided via optical systems. Therefore, there are cases in which the magnifications of the optical systems (the optical magnifications) vary due to physical differences among the optical systems or the assembled states thereof, or the environmental temperature or humidity or the like. In such cases, at the recording element units which are arranged two-dimensionally, the positions of the dot patterns vary due to the changes in the optical magnifications.

Thus, the displacement amounts of the positions of the light beam spots on the image recording surface generated by the changes in the optical magnifications of the optical systems are measured at the displacement amount measuring mechanism.

At the light-emitting timing changing mechanism, the light-emitting timing at the start of scan is changed on the basis of the displacement amount in the scanning direction, among the displacement amounts measured at the displacement amount measuring mechanism.

Further, at the resolution changing mechanism, the resolution in the direction intersecting the scanning direction is changed on the basis of the displacement amount in the direction intersecting the scanning direction, among the displacement amounts measured at the displacement amount measuring mechanism. Namely, the resolution is changed so that the line width becomes the same as the predetermined line width recorded at the time of standard magnification.

In this way, an adjusting mechanism which mechanically adjusts the positions of the recording element units or the like is not needed, and even if there are fluctuations in the optical magnifications, positional offset does not arise.

In the present invention, the modulation control can handle various types of modulation control such as on/off modulation control, pulse width modulation control, surface area modulation control, and the like, and the present invention is not limited by the method of modulation control.

DETAILED DESCRIPTION OF THE INVENTION

Figure 1:
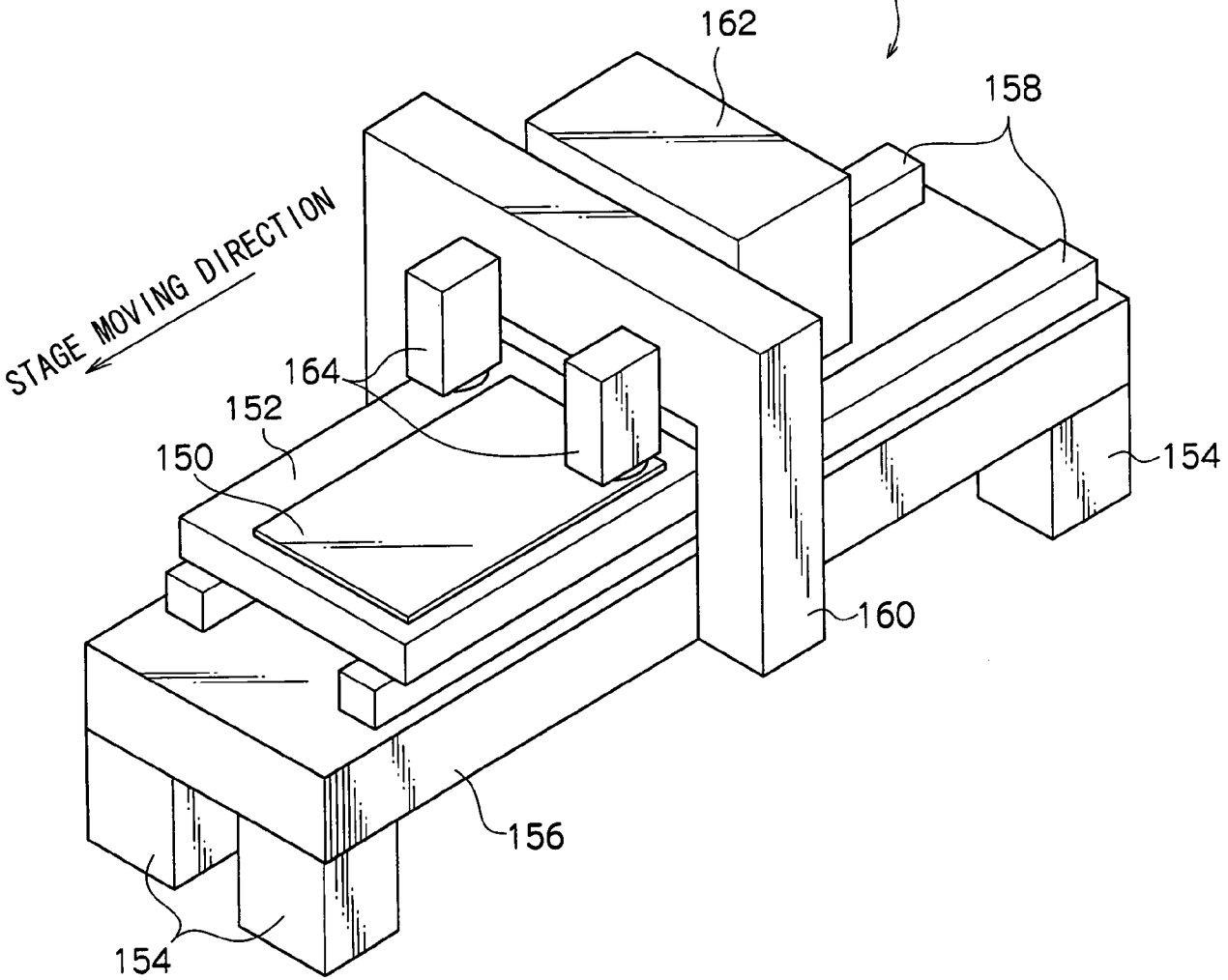
FIG. 1 is a perspective view showing the exterior of an image recording device of an embodiment of the present invention.

A flatbed-type image recording device 100 relating to the present embodiment is shown in FIG. 1.

The image recording device 100 has a setting stand 156 which is shaped as a thick plate and which is supported by four leg portions 154. Further, the image recording device 100 has a flat-plate-shaped stage 152 disposed via two guides 158 which extend along the stage moving direction. The stage 152 functions to suck and hold a sheet-shaped photosensitive material 150 to the surface of the stage 152.

The longitudinal direction of the stage 152 is the stage moving direction. The stage 152 is guided by the guides 158, and is supported so as to be reciprocatingly movable (scannable). Note that an unillustrated driving device for driving the stage 152 along the guides 158 is provided at the exposure device 100. Driving control is carried out by an unillustrated controller such that the stage 152 moves at a moving speed (scanning speed) corresponding to a desired magnification in the scanning direction by using this drive device.

A U-shaped gate 160, which straddles over the path of movement of the stage 152, is provided at the central portion of the setting stand 156. The end portions of the U-shaped gate 160 are fixed to the both side surfaces of the setting stand 156. A recording head 162 is provided at one side of the gate 160. A plurality of sensors 164 (e.g., two sensors 164 in the present embodiment), which sense the leading end and the trailing end of the photosensitive material 150, are provided at the other side of the gate 160.

Figure 2:
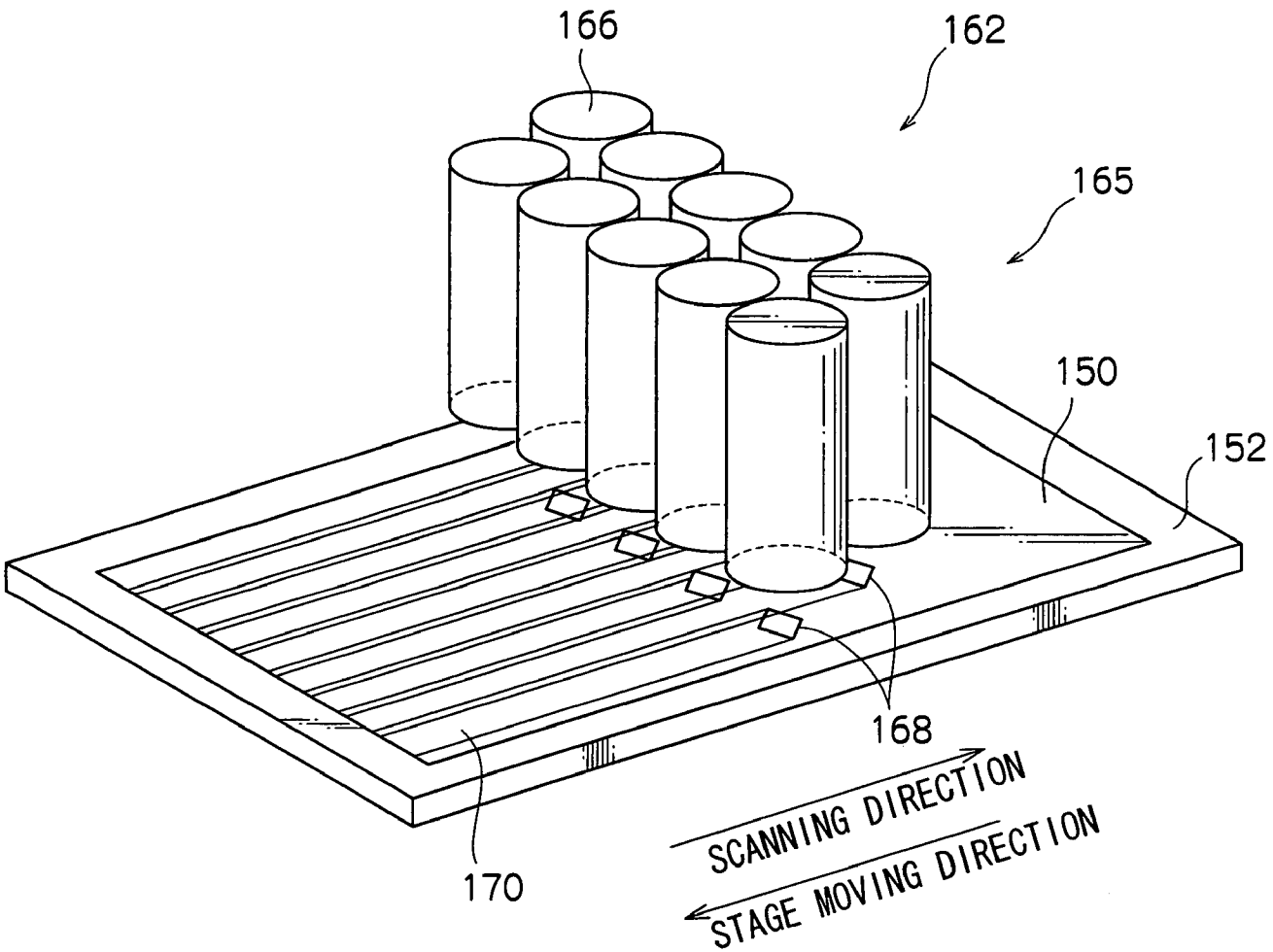
FIG. 2 is a perspective view showing the structure of a recording head of the image recording device of the embodiment of the present invention.

As shown in FIG. 2, the recording head 162 has a plurality of recording element units 166. The photosensitive material 150 is exposed by moving (scanning) the stage 152 simultaneously with illuminating, onto the photosensitive material 150 on the stage 152, a plurality of light beams which are irradiated from the respective recording element units 166 at a predetermined timing.

Figure 3A:
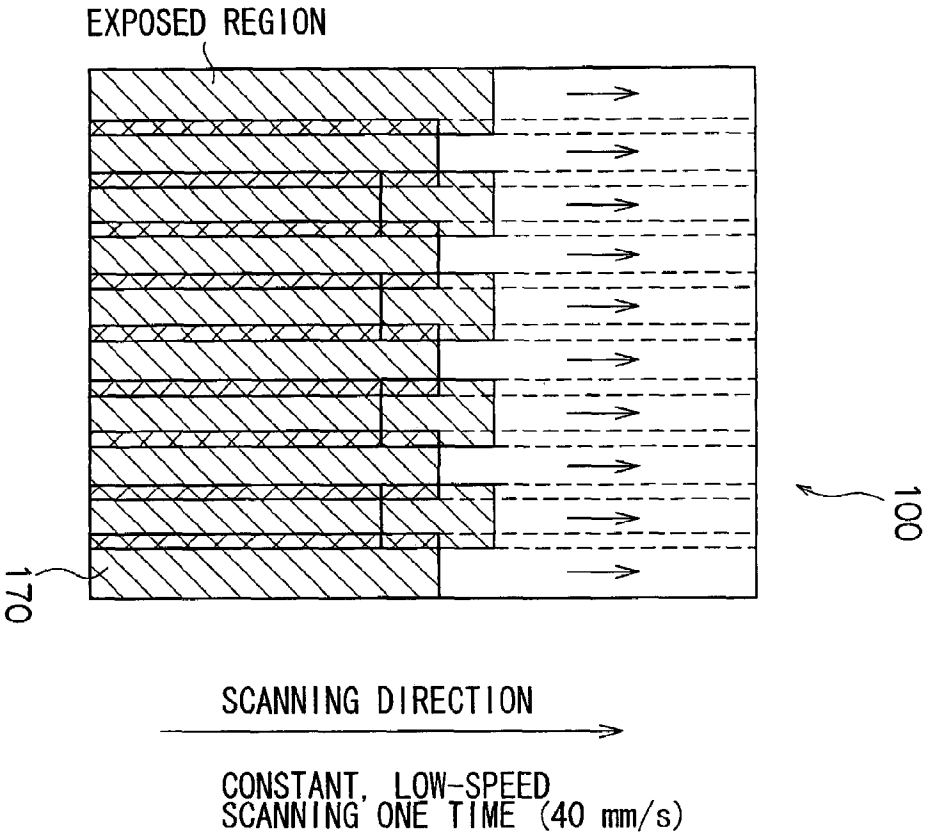
FIG. 3A is a plan view showing exposed regions formed on a photosensitive material in the embodiment of the present invention.
Figure 3B:
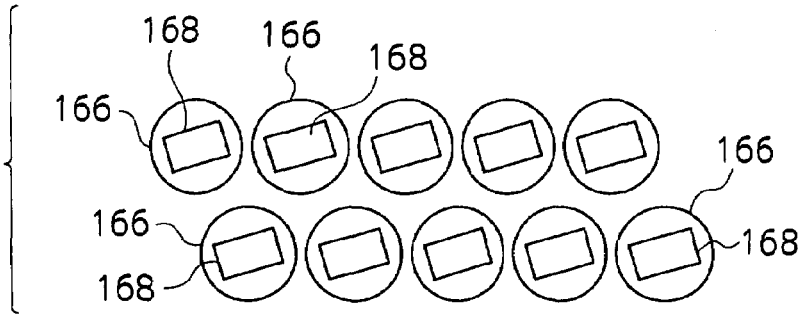
FIG. 3B is a diagram showing the arrangement of exposure areas of respective exposure heads relating to the embodiment of the present invention.

As shown in FIGS. 2 and 3B, the recording element units 166 structuring the recording head 162 are arranged in a substantial matrix form of m lines and n columns (e.g., two lines and five columns in the present embodiment). The plural recording element units 166 are arranged in the direction orthogonal to the scanning direction. In the present embodiment, due to the relationship with the width of the photosensitive material 150, there are a total of ten of the recording element units 166 in two lines.

Here, an exposure area 168 of the recording element unit 166 is in the shape of a rectangle whose short side runs along the scanning direction. The exposure area 168 is inclined at a predetermined angle of inclination with respect to the scanning direction. As the stage 152 moves, a strip-shaped exposed region 170 is formed on the photosensitive material 150 by each of the recording element units 166.

Each of the recording element units controls, in units of dots, the incident light beam by an unillustrated digital micromirror device (DMD) which is a spatial light modulator. Dot patterns are exposed on the photosensitive material 150, and the density of one pixel is expressed by a plurality of dot patterns.

Figure 4:
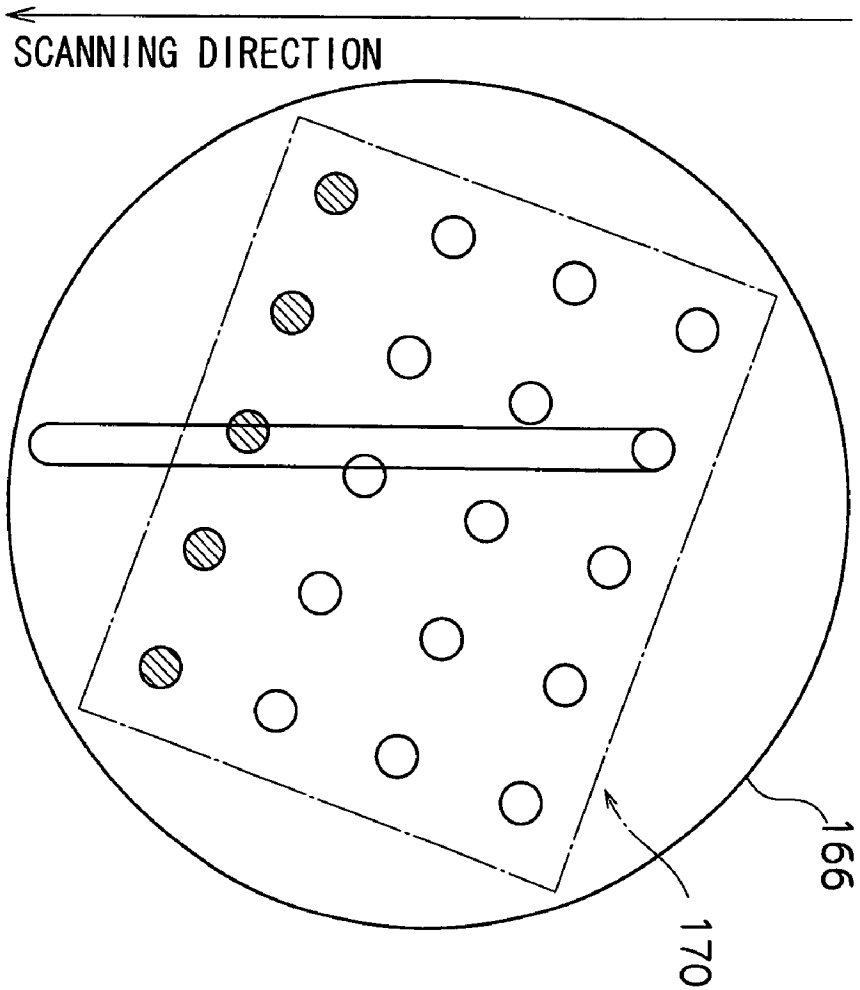
FIG. 4 is a plan view showing a state of arrangement of dots of a recording element unit relating to the embodiment of the present invention.

As shown in FIG. 4, the aforementioned strip-shaped exposed region 170 (one of the recording element units 166) is formed by 20 dots (refer to the solid lines in FIG. 4) which are arranged two-dimensionally (4×5).

The aforementioned, two-dimensionally-arranged dot pattern is inclined with respect to the scanning direction. In this way, the respective dots which are arranged in the scanning direction pass through between the dots which are arranged in the direction intersecting the scanning direction, and the resolution can be increased. Note that, with the inclining of the recording element units 166 as described above, there are cases in which a plurality of dot patterns overlap on the same scan line, depending on the setting of the standard resolution of the device. In such cases, it suffices to always turn off the DMD corresponding to any one of the dot patterns (in FIG. 4, the dot pattern illustrated by hatching) so as to provide a dot pattern which is not used.

A standard magnification is set in the optical system which includes the above-described DMD. However, there are cases in which the optical magnification varies due to physical differences (e.g. instrumental errors) in respective optical systems, errors in the assembly positions, and changes over time caused by the environmental temperature or humidity or the like.

When the optical magnification varies toward the larger side, as shown by the chain line in FIG. 4, the position of the dot pattern changes. Namely, when image recording is carried out at an enlarged magnification with the structure as is in this state, in the scanning direction, the recording start position is offset due to the magnification error, and in the direction intersecting the scanning direction, the dimension of the image is enlarged.

Note that, even in cases in which the optical magnification varies so as to be smaller than the standard magnification, similar phenomena of offset of the scanning start position and reduction of the dimension of the image arise.

Thus, in the present embodiment, the position of the dot pattern is measured in advance before image recording, and the amounts of displacement between this dot pattern position and the dot pattern position at the time of standard magnification are computed. On the basis of these computed amounts of displacement, correction in the scanning direction (changing of the timing of the start of scanning) and correction in the direction intersecting the scanning direction (changing of the resolution) are carried out.

Figure 5:
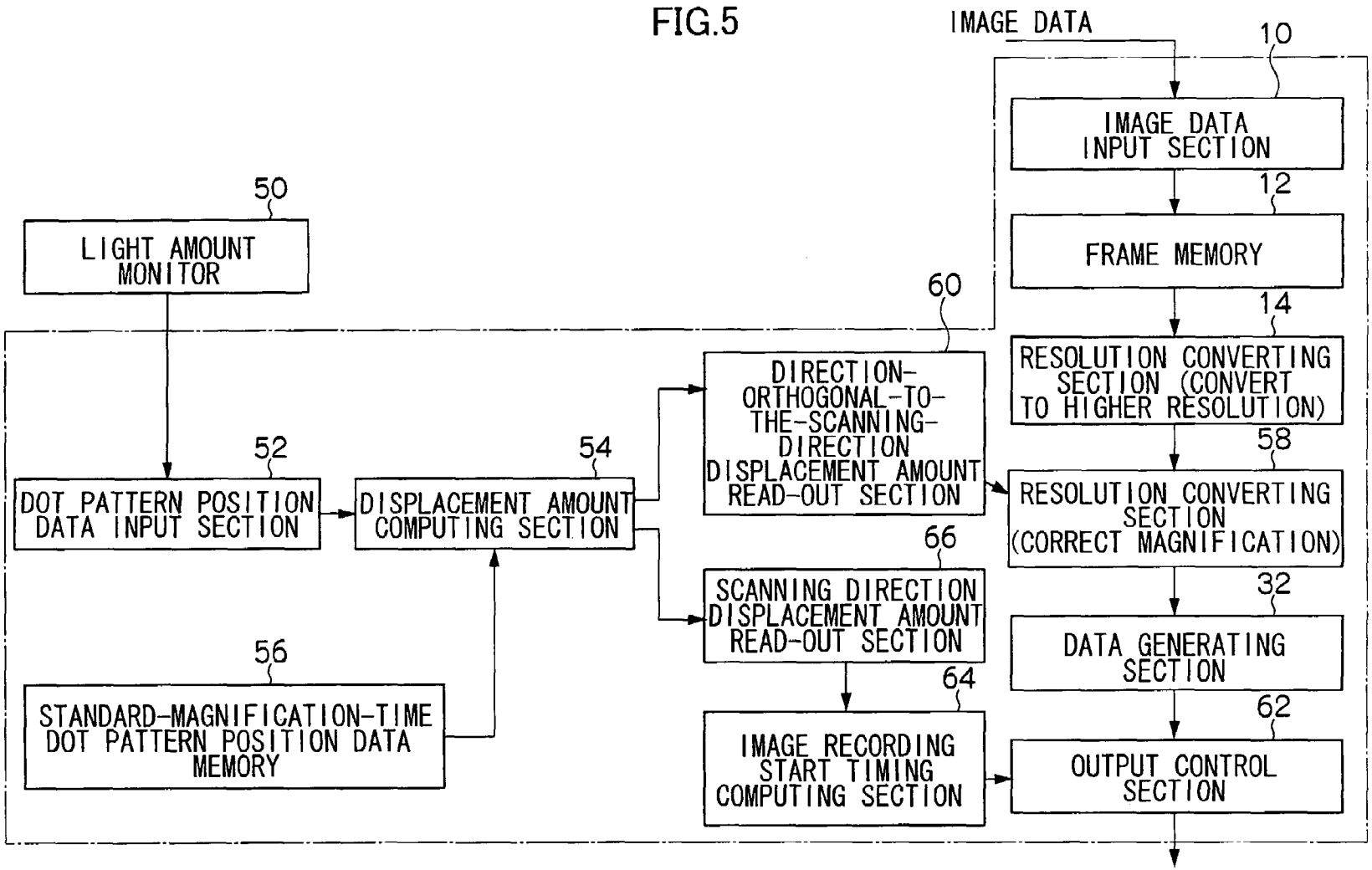
FIG. 5 is a control block diagram showing a control system for image data correction relating to the embodiment of the present invention.

A functional block diagram for the control of correction of input image data in a case in which the optical magnification varies is shown in FIG. 5.

A light amount monitor 50 is disposed at the stage 152 of the image recording device 100 at a position which is equivalent to that of the photosensitive material 150. Apertures which can measure the amounts of light in units of dots are provided at the light amount monitor 50. The positions of the two-dimensionally-arranged dot patterns of the respective recording element units 166 can thereby be confirmed.

In such a state, by turning on all of the recording element units 166 (setting all of the DMDs in an on state) and moving the light amount monitor in the direction intersecting the scanning direction, the positions of the peak light amounts (the positions of the respective dot patterns) can be confirmed.

The light amount monitor 50 is connected to a dot pattern position data input section 52. Position information of the respective dot patterns is inputted to the dot pattern position data input section 52.

The dot pattern position data input section 52 is connected to a displacement amount computing section 54. A standard-magnification-time dot pattern position data memory 56 is connected to the displacement amount computing section 54. Dot pattern position data at the time of standard magnification is stored in advance in the standard-magnification-time dot pattern position data memory 56. The displacement amount computing section 54 reads out this dot pattern position data at the time of standard magnification, and computes the difference between this data and the current dot pattern position data which is sent from the dot pattern position data input section 52, i.e., computes the amounts of displacement.

On the other hand, image data is inputted to an image data input section 10 and stored in a frame memory 12.

The image data stored in the frame memory 12 is sent to a resolution converting section 14, and is converted to high resolution. In the present embodiment, this conversion to high resolution is carried out, and one pixel is expressed by a plurality of dot patterns.

A resolution converting section 58 for magnification correction is connected to the resolution converting section 14.

In the resolution converting section 58 for magnification correction, the resolution is changed on the basis of the amount of displacement of the dot pattern computed at the displacement amount computing section 54.

Namely, the displacement amount in the direction orthogonal to the scanning direction is read out from the displacement amount computing section 54 by a direction-orthogonal-to-the-scanning-direction displacement amount read-out section 60. The resolution is changed on the basis of the amount of displacement in the direction orthogonal to the scanning direction.

Figure 6A:
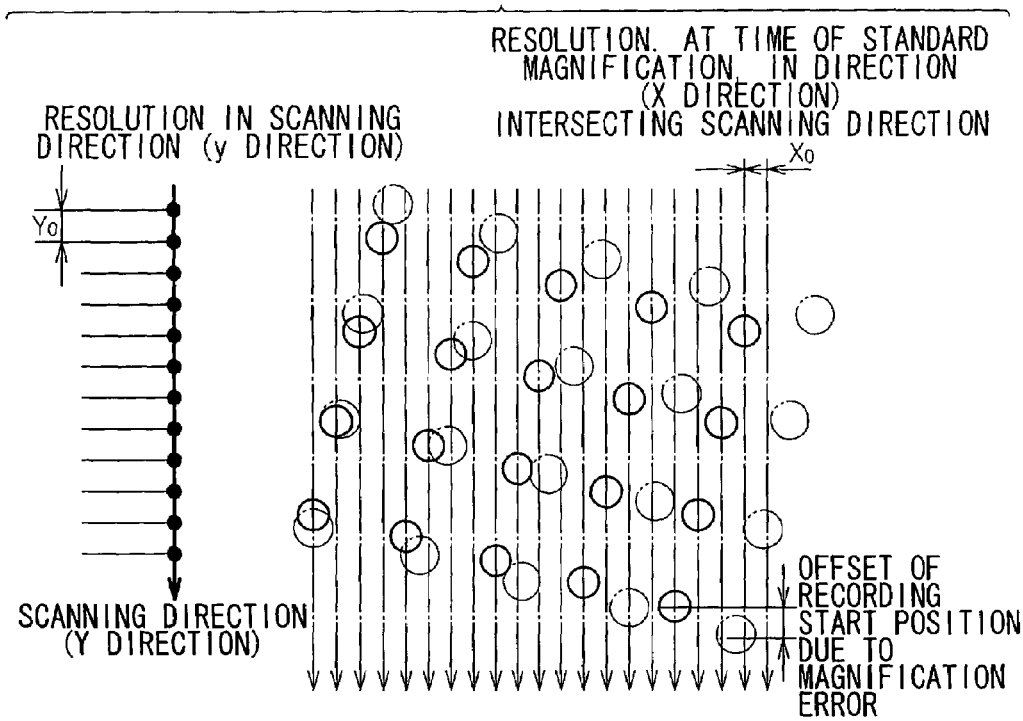
FIG. 6A is a plan view showing, in an overlapping manner, dot patterns at a time of standard magnification and at a time of enlarged magnification.
Figure 6B:
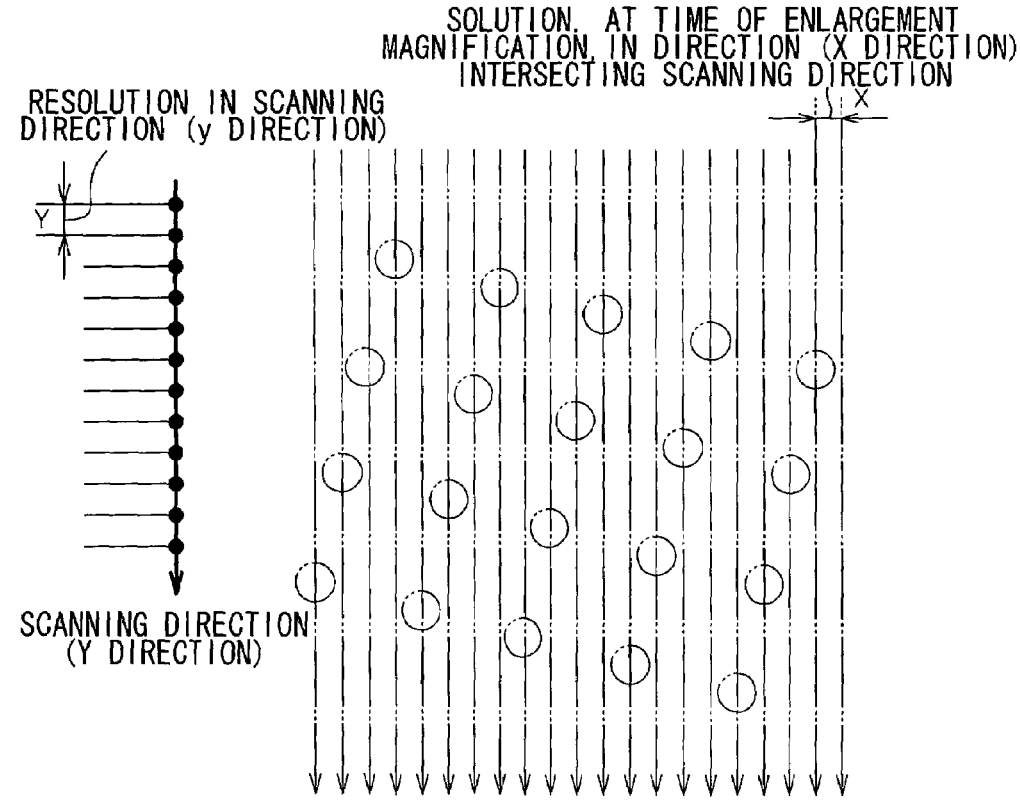
FIG. 6B is a plan view of a dot pattern at the time of enlarged magnification.

For example, as shown in FIGS. 6A and 6B, in a case in which the optical magnification is fluctuating toward the higher side, for a resolution X0 at the time of standard magnification, the resolution at the time of enlarged magnification changes to X. On the basis of this difference (|X−X0|), the number of dot patterns in the direction orthogonal to the scanning direction is reduced. Namely, a section to be recorded by four lines at the time of standard magnification is recorded by three lines, and the line widths are made to coincide.

In the resolution converting section 58 for magnification correction, the image data, for which a change in resolution for the purpose of magnification correction has been carried out, is sent to a data generating section 32. Data of the respective recording element units, which is the final image data, is generated, and is sent to an output control section 62.

A recording start timing signal, which is computed at an image recording start timing computing section 64, is inputted to the output control section 62. Output of data is started on the basis of this recording start timing.

The displacement amount in the scanning direction, which is read out from the displacement amount computing section 54 by a scanning direction displacement amount read-out section 66, is inputted to the image recording start timing computing section 64. The timing for the start of recording is computed on the basis of this displacement amount.

Namely, as shown in FIG. 6A, when the optical magnification varies toward the greater side with respect to the standard magnification, offset in the recording start timing arises due to this magnification error. Therefore, it suffices to change the data output timing in order to cancel this offset. In a case in which the optical magnification varies toward the greater side as described above, it suffices to delay the image recording start timing. Further, when the optical magnification varies toward the lower side, it suffices to advance the image recording timing.

Note that the illumination timings (y0 at the time of standard magnification, y at the time of enlargement magnification) of the respective dot patterns, which are the resolution in the scanning direction, are the same timings regardless of the change in magnification (see FIGS. 6A and 6B).

Operation of the present embodiment will be described hereinafter.

Generation of Dot Pattern Displacement Amount

In usual image recording, the photosensitive material 150 is positioned on the stage. In a case in which the dot pattern displacement amount is to be obtained, the light amount monitor is set at a position equivalent to the position of the photosensitive material 150.

In this state, the entire recording head 162 is lit. Namely, modulation, by the DMDs, of all of the dots illuminated from the respective recording element units 166 is turned on.

The positions of the respective dots are measured due to the provision of the apertures at the light amount monitor 50.

The dot pattern position data obtained in this way is inputted to the dot pattern position data input section 52 synchronously with the input of image data to the image data input section 10. Next, at the displacement amount computing section 54, this dot pattern position data is compared with the dot pattern position data at the time of standard magnification, which is stored in advance in the standard-magnification-time dot pattern position data memory 56, and the amounts of displacement are computed.

The image data inputted to the image data input section 10 is stored once in the frame memory 12, and is read-out line-by-line (the regions to be recorded simultaneously in the direction orthogonal to the scanning direction), and is converted into high resolution at the resolution converting section 14.

Next, this image data is sent to the resolution converting section 58 for magnification correction. The resolution is converted on the basis of the displacement amount in the direction orthogonal to the scanning direction (the read-out at the direction-orthogonal-to-the-scanning-direction displacement amount read-out section 60), among the displacement amounts computed at the displacement amount computing section 54.

Namely, when the magnification varies so as to be larger than the standard magnification, enlargement of the image in the direction orthogonal to the scanning direction is prevented by lowering the resolution.

Further, when the magnification varies so as to be smaller than the standard magnification, reduction of the image in the direction orthogonal to the scanning direction is prevented by increasing the resolution.

The image data for which the above-described magnification correction has been carried out is sent to the data generating section 32 where data of the DMDs is generated and sent to the output control section 62.

Here, at the output control section 62, in order to correct the offset in the image recording start position caused by the change in the optical magnification, the output is controlled on the basis of the image recording start timing computed at the image recording start timing computing section 64.

Namely, at the image recording start timing computing section 64, timing for canceling the offset at the start of image recording is computed on the basis of the displacement amount in the scanning direction (the read-out at the scanning direction displacement amount read-out section 66) among the displacement amounts computed at the displacement amount computing section 54.

When the optical magnification varies toward the higher side of the standard magnification, because the dot pattern which is to be recorded first is advanced in the scanning direction, the image recording start is delayed on the basis of the amount of advance and the scanning speed. Further, when the optical magnification varies toward the lower side of the standard magnification, because the dot pattern which is to be recorded first is delayed in the direction opposite to the scanning direction, the image recording start is set to be earlier on the basis of the amount of delay and the scanning speed.

Flow of Image Recording

The stage 152, to whose surface the photosensitive material 150 is sucked, is moved, by the unillustrated drive device, at a constant speed from the upstream side of the gate 160 to the downstream side thereof along the guides 158. While the stage 152 is passing under the gate 160, when the leading end of the photosensitive material 150 is detected by the sensors 164 mounted to the gate 160, the micromirrors of the DMDs are respectively controlled for each recording element unit 166 on the basis of the aforementioned generated data.

Namely, when laser light is illuminated onto the DMDs, the laser lights, which are reflected when the micromirrors of the DMDs are in an on state, are guided to the photosensitive material 150 via optical systems, and are focused on the photosensitive material 150.

As described above, in the present embodiment, the fluctuation in the optical magnification, which is caused by physical differences of the respective optical systems at the plurality of recording element units 166 provided at the recording head 162, errors in the assembly positions, and changes over time due to the environmental temperature or humidity or the like (i.e., the fluctuation caused by physical positions or physical changes), is recognized in advance by measurement by the light amount monitor 50. The image recording start timing in the scanning direction is corrected on the basis of this displacement amount. Further, by changing the resolution in the direction orthogonal to the scanning direction, the position of the image at the time of the standard magnification is maintained. Therefore, offset of the image recording position with respect to the photosensitive material 150 can be eliminated, without providing a complex adjusting mechanism for adjusting the recording element units 166 by rotating and moving them or the like.

Note that, in the present embodiment, the DMDs are used as spatial modulators, and the dot patterns are generated by turning the DMDs on and off such that the lighting times are constant. However, pulse width modulation by controlling the on time ratio (the duty ratio) may be carried out. Further, the dot patterns may be generated by carrying out lighting plural times, with the time for each one lighting being extremely short.

In the present embodiment, explanation has been given regarding the recording element units 166 which have DMDs as spatial light modulators. However, other than such a reflecting-type spatial light modulator, a transmitting-type spatial light modulator (LCD) can be used. For example, a micro electro mechanical system (MEMS) type spatial light modulator (SLM), or a spatial light modulator other than a MEMS type, such as an optical element which modulates transmitted light in accordance with the electrooptical effect (a PLZT element), or a liquid crystal shutter array like a liquid crystal light shutter (FLC), or the like may be used. Note that "MEMS" collectively refers to minute systems in which micro-sized sensors, actuators and control circuits, which are formed by micromachining techniques based on IC manufacturing processes, are integrated. A MEMS type spatial light modulator means a spatial light modulator which is driven by electromechanical operation using static electricity. Moreover, a structure in which a plurality of grating light valves (GLVs) are arranged in a two-dimensional form can be used. In structures using reflecting-type spatial light modulators (GLVs) and transmitting-type spatial light modulators (LCDs), a lamp or the like can be used as the light source, rather than the aforementioned laser.

A fiber array light source having a plurality of multiplex laser light sources; a fiber array light source in which fiber light sources, each of which has one optical fiber which emits laser light which is incident thereto from a single semiconductor laser having one light-emitting point, are set in the form of an array; a light source in which a plurality of light-emitting points are arranged in two dimensions (e.g., an LD array, an organic EL array, and the like); or the like can be used as the light source in the above-described embodiment.

Further, for example, the image recording device 100 of the present embodiment can be suitably used in applications such as the exposure of a dry film resist (DFR) in the process of manufacturing a printed wiring board (PWB); the formation of a color filter in the process of manufacturing a liquid crystal display (LCD); the exposure of a DFR in the process of manufacturing a TFT; the exposure of a DFR in the process of manufacturing a plasma display panel (PDP); or the like.

Either of a photon-mode photosensitive material on which information is directly recorded by exposure, or a heat-mode photosensitive material on which information is recorded by heat generated by exposure, may be used in the above-described image recording device 100. In a case in which a photon-mode photosensitive material is used, a GaN semiconductor laser, a wavelength converting solid state laser, or the like is used as the laser device. Further, in a case in which a heat-mode photosensitive material is used, an AlGaAs semiconductor laser (infrared laser) or a solid state laser is used as the laser device.

As described above, the present invention has the excellent effect that, in a case in which an image is recorded by a recording head which is structured by lining-up a plurality of recording element units in a direction intersecting a scanning direction, even if errors in the optical magnifications of the respective recording element units arise, offset of the image recording positions can be corrected without using a mechanical adjusting mechanism.

What is claimed is:

1. An image recording method of recording an image onto an image recording surface by dot patterns by scanning, along the image recording surface, a recording head which is structured such that a plurality of recording element units are arranged in a direction intersecting a scanning direction, the recording element units having a light source and an optical system which receives light from the light source, forms light beams which are arranged two-dimensionally, and focuses the light beams on the image recording surface, the method comprising:

measuring displacement amounts of positions of light beam spots on the image recording surface generated due to a change in optical magnification of the optical system;

changing a light-emitting timing at a time of start of scanning in the scanning direction, on the basis of a displacement amount in the scanning direction; and changing a resolution in the direction intersecting the scanning direction, on the basis of a displacement amount in the direction intersecting the scanning direction.

2. The image recording method of claim 1, wherein the changing of the resolution in the direction intersecting the scanning direction is changing a number of dot patterns so that a line width in the direction intersecting the scanning direction becomes the same as a predetermined line width in the direction intersecting the scanning direction recorded at a predetermined optical magnification.

3. The image recording method of claim 1, wherein, when a dot pattern which is first recorded is advanced in the scanning direction, the light-emitting timing is made to be later than a predetermined timing.

4. The image recording method of claim 1, wherein, when a dot pattern which is first recorded is late in a direction opposite the scanning direction, the light-emitting timing is made to be earlier than a predetermined timing.

5. The image recording method of claim 1, wherein, when the optical magnification varies toward a side greater than a predetermined optical magnification, the resolution is made to be lower than a predetermined resolution.

6. The image recording method of claim 1, wherein, when the optical magnification varies toward a side smaller than a predetermined optical magnification, and the resolution is made to be higher than a predetermined resolution.

7. The image recording method of claim 1, wherein inputting of image data is carried out synchronously with measuring of the displacement amounts.

8. The image recording method of claim 7, wherein the resolution is changed on the basis of the measured displacement amount.

9. The image recording method of claim 1, further comprising storing in advance a predetermined magnification of the optical system, the predetermined magnification being a magnification which is set in advance to the optical system.

10. The image recording method of claim 1, wherein the direction intersecting the scanning direction is a direction orthogonal to the scanning direction.

11. The image recording apparatus of claim 1, wherein the resolution is a number of dots in a predetermined length in the scanning direction.

12. The image recording method of claim 1, wherein measuring the displacement comprises calculating a difference between a position of a dot pattern before image recording and a position of the dot pattern at a time of predetermined magnification.

13. An image recording device for recording an image onto an image recording surface by dot patterns by scanning, along the image recording surface, a recording head which is structured such that a plurality of recording element units are arranged in a direction intersecting a scanning direction, the recording element units having a light source and an optical system which receives light from the light source, forms light beams which are arranged two-dimensionally, and focuses the light beams on the image recording surface, the device comprising:

a displacement amount measuring mechanism measuring displacement amounts of positions of light beam spots on the image recording surface generated due to a change in optical magnification of the optical system;

a light-emitting timing changing mechanism changing a light-emitting timing at a time of start of scanning in the scanning direction, on the basis of a displacement amount in the scanning direction; and a resolution changing mechanism changing a resolution in the direction intersecting the scanning direction, on the basis of a displacement amount in the direction intersecting the scanning direction.

14. The image recording device of claim 13, wherein, when a dot pattern which is first recorded is advanced in the scanning direction, the light-emitting timing changing mechanism makes the light-emitting timing be later than a predetermined timing.

15. The image recording device of claim 13, wherein, when a dot pattern which is first recorded is late in a direction opposite the scanning direction, the light-emitting timing changing mechanism makes the light-emitting timing be earlier than a predetermined timing.

16. The image recording device of claim 13, wherein the resolution changing mechanism changes the resolution so that a line width becomes the same as a predetermined line width recorded at a time of a predetermined magnification.

17. The image recording device of claim 13, wherein, when the optical magnification varies toward a side greater than a predetermined optical magnification, the resolution changing mechanism makes the resolution be lower than a predetermined resolution.

18. The image recording device of claim 13, wherein, when the optical magnification varies toward a side smaller than a predetermined optical magnification, the resolution changing mechanism makes the resolution be higher than a predetermined resolution.

19. The image recording device of claim 13, further comprising a storage device storing inputted image data.

20. The image recording device of claim 13, further comprising a memory which stores in advance a predetermined magnification of the optical system, the predetermined magnification being a magnification which is set in advance to the optical system.

* * * * *